US007850150B2

(12) United States Patent
Mockry et al.

(10) Patent No.: US 7,850,150 B2
(45) Date of Patent: Dec. 14, 2010

(54) SUPPORT GRID APPARATUS AND METHOD

(75) Inventors: Eldon F. Mockry, Lenexa, KS (US); Ohler L. Kinney, Jr., Overland Park, KS (US); Kathryn L. Pullen, Lenexa, KS (US)

(73) Assignee: SPX Cooling Technologies, Overland Park, KS (US)

( * ) Notice: Subject to any disclaimer, the term of this patent is extended or adjusted under 35 U.S.C. 154(b) by 400 days.

(21) Appl. No.: 11/896,194

(22) Filed: Aug. 30, 2007

(65) Prior Publication Data

US 2007/0295884 A1 Dec. 27, 2007

Related U.S. Application Data

(62) Division of application No. 11/042,151, filed on Jan. 26, 2005, now Pat. No. 7,275,736.

(51) Int. Cl.
*B01F 3/04* (2006.01)

(52) U.S. Cl. ..... 261/111; 261/DIG. 11; 52/664

(58) Field of Classification Search ..... 261/108, 261/111, 113, DIG. 11; 52/664, 665, 676; 29/890.07

See application file for complete search history.

(56) References Cited

U.S. PATENT DOCUMENTS 3,398,497 A 8/1968 Hellmich et al.
3,749,381 A 7/1973 Furlong et al.
3,791,634 A 2/1974 Phelps
3,950,911 A 4/1976 Fox, Jr.
4,512,937 A 4/1985 Hoffmann
4,868,956 A 9/1989 Shepherd
4,915,877 A 4/1990 Shepherd
5,133,123 A 7/1992 Rigg
5,447,004 A 9/1995 Vrnak
5,572,845 A 11/1996 DeSouza
6,708,960 B2 3/2004 Olson et al.
D547,428 S * 7/2007 Kinney et al. ..... D23/351
7,275,736 B2 * 10/2007 Mockry et al. ..... 261/111
2003/0011083 A1 1/2003 Olson et al.
2004/0099968 A1 * 5/2004 Olson et al. ..... 261/111
2007/0176308 A1 * 8/2007 Shepherd ..... 261/111

* cited by examiner

*Primary Examiner*—Scott Bushey
(74) *Attorney, Agent, or Firm*—Baker & Hostetler LLP

(57) ABSTRACT

A support grid having a longitudinal axis, having a frame. The frame includes a series of columns that extend generally parallel to the longitudinal axis and a series of girts that intersect the series of columns to form a plurality of windows. The support grid also includes a first retainer integral with the frame. The first retainer extends from the frame into at least one of the plurality of windows at a first axial location. The support grid also includes slider portions that extend in opposed relation for the frame into the at least one plurality of windows.

7 Claims, 7 Drawing Sheets

SUPPORT GRID APPARATUS AND METHOD

CROSS-RELATED APPLICATIONS

This application is a divisional application of U.S. Ser. No. 11/042,151 filed Jan. 26, 2005, now U.S. Pat. No. 7,275,736, issued on Oct. 2, 2007, the contents of which is hereby incorporated by reference in its entirety.

FIELD OF THE INVENTION

This invention relates generally to an apparatus and method for supporting splash bars or the like in a cooling tower, for example. More particularly, the present invention relates, for example, to an improved apparatus and method for installing and supporting splash bars on a cooling tower support grid having unitary retaining clips.

BACKGROUND OF THE INVENTION

A number of heat exchange apparatuses exist wherein a liquid and a gas are brought into direct contact with each other for effecting a transfer of heat and mass from one fluid to the other, for example, cooling towers.

In typical cooling tower constructions, hot liquid to be cooled gravitates downwardly through the cooling tower while air is simultaneously circulated through the tower. The cooling of the liquid is basically accomplished by the direct contact of the air and liquid, wherein heat is transferred from the surface of the liquid to the circulating air. The efficiency with which the aforementioned direct contact heat transfer occurs is primarily dependent on the amount of liquid surface area that is generated within the heat exchange apparatus and the amount of that surface area comes into contact with the air.

Most of the heat exchange apparatuses designed for these types of processes employ some physical structure, such as a heat transfer media or fill assembly, whose primary purpose is to provide liquid surface area for heat exchange. This surface area functions to increase fluid-air contact, therefore providing more heat exchange between the liquid and gas. The heat transfer media can include, for example, a splash bar type heat transfer media which promotes the generation of liquid droplets, or it may alternatively include a film type heat transfer media, which promotes the generation of thin, liquid films for heat exchange.

The aforementioned splash bars typically span large distances across the cooling tower in which they are employed. The splash bars are typically supported in the cooling tower by a series of frame assemblies and/or support grids that function to support the individual bars while also preventing the sagging of the bars. The support grids function to offset the splash bars both vertically and horizontally, providing maximum surface area for the falling liquid to contact, providing for heat exchange between the liquid and air. The support grids typically employ bar attachment features such as separate wires or clips that secure the individual splash bars to the support grids, because there is a tendency for the splash bars to become dislodged or loose, due to impingement by water and the air flow through the cooling tower. Theses clips are typically connected to the grids via mechanical attachment methods and/or means. Alternatively, the aforementioned clips may be integral with the grids.

The aforementioned support grids and bar attachment features have drawbacks however. The use of the support grids which employ the separate wires or clips can be somewhat costly in terms of material cost and/or the amount of time required for installation, because present techniques for mounting the wire or clips are undesirable and labor intensive. Also, while the support grids with integral clips alleviate some or all of the labor required to mount the individual clips, the presence of the internal clips can make the mounting of splash bars difficult during cooling tower assembly. For example, cooling towers oftentimes employ very lengthy elongated splash bars or the like that span multiple bays within the tower and therefore the splash bars are supported by multiple support grids. Accordingly, the splash bars are slid from one grid to the other during cooling tower assembly. The aforementioned sliding of the bars oftentimes causes the splash bars to snag or catch the integral clips, causing the clips to deform or break. Thus, installation of the of the splash bars again becomes labor intensive, requiring that the bars be supported or lifted over the clips by multiple "installers" in order to prevent the deformation or breaking of the clips during splash bar installation.

Accordingly, there is a need in the art to provide an apparatus and method for supporting and fastening cooling tower splash bars or the like. It is further desirable to provide a cooling tower support grid that provides for the effective and efficient, in terms of cost and labor, mounting of splash bars during the assembly of cooling towers.

SUMMARY OF THE INVENTION

The foregoing needs are met, to a great extent, by the present invention, wherein aspects of a support grid apparatus and method are provided.

In accordance with an embodiment of the present invention, a support grid having a longitudinal axis is provided, comprising: a frame, wherein said frame comprises: a series of columns that extend generally parallel to the longitudinal axis; a series of girts that intersect said series of columns to form a plurality of openings having a width and a height; a first retainer integral with said frame, wherein said first retainer extends from said frame into at least one of said plurality of windows at a first axial position along the longitudinal axis; and slider portions that extend in opposed relation from said frame into said at least one of said plurality of windows at second axial position along the longitudinal axis.

In accordance with another embodiment of the present invention, a method for installing and retaining a splash bar on a support grid having a longitudinal axis and frame having a series of columns and a series of girts that intersect said series of columns to form a plurality of windows having a width and a height is provided, comprising: supporting the splash bar on a pair of slider portions that extend in opposed relation from the frame into at least one of the plurality of windows at a first axial location thereof; sliding the splash bar along the slider portions; transitioning the splash bar from the slider portions along the longitudinal axis to engage a first retainer integral with the frame, wherein the retainer extends from the frame into the least one of the plurality of windows at a second axial position thereof; and retaining the splash bar to the support grid via the first retainer.

In accordance with yet another embodiment of the present invention, a support grid having a longitudinal axis is provided, comprising: a frame having a series of columns and a series of girts that intersect said series of columns to form a plurality of windows having a width and a height, comprising: means for supporting the splash bar, wherein said means for supporting includes a pair of means for sliding that extend in opposed relation from the frame into said at least one of the plurality of windows at a first axial location thereof; and means retaining the splash bar to the support grid via a retaining means.

In accordance with still another embodiment of the present invention, a cooling tower is provided, comprising: a water supply; a basin; a frame having: a series of columns that extend generally parallel to the longitudinal axis; a series of girts that intersect said series of columns to form a plurality of openings having a width and a height; a first retainer integral with said frame, wherein said first retainer extends from said frame into at least one of said plurality of windows at a first axial position along the longitudinal axis; and slider portions that extend in opposed relation from said frame into said at least one of said plurality of windows at second axial position along the longitudinal axis.

In accordance with another embodiment of the present invention, a support grid having a longitudinal axis is provided, comprising: a frame, wherein said frame comprises: a series of columns that extend generally parallel to the longitudinal axis; a series of girts that intersect said series of columns to form a plurality of openings having a width and a height; a first retainer integral with said frame, wherein said first retainer extends from said frame into at least one of said plurality of windows at a first axial position along the longitudinal axis; a second retainer integral with said frame, wherein said second retainer extends from said frame into said at least one of said plurality of window at said first axial position in opposed relation to said first retainer; a third retainer integral with said frame, wherein said third retainer extends from said frame into said at least one of said plurality of windows at a third axial position along the longitudinal axis; and a fourth retainer integral with said frame, wherein said fourth retainer extends from said frame into said at least one of said plurality of window at said third axial position in opposed relation to said third retainer.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
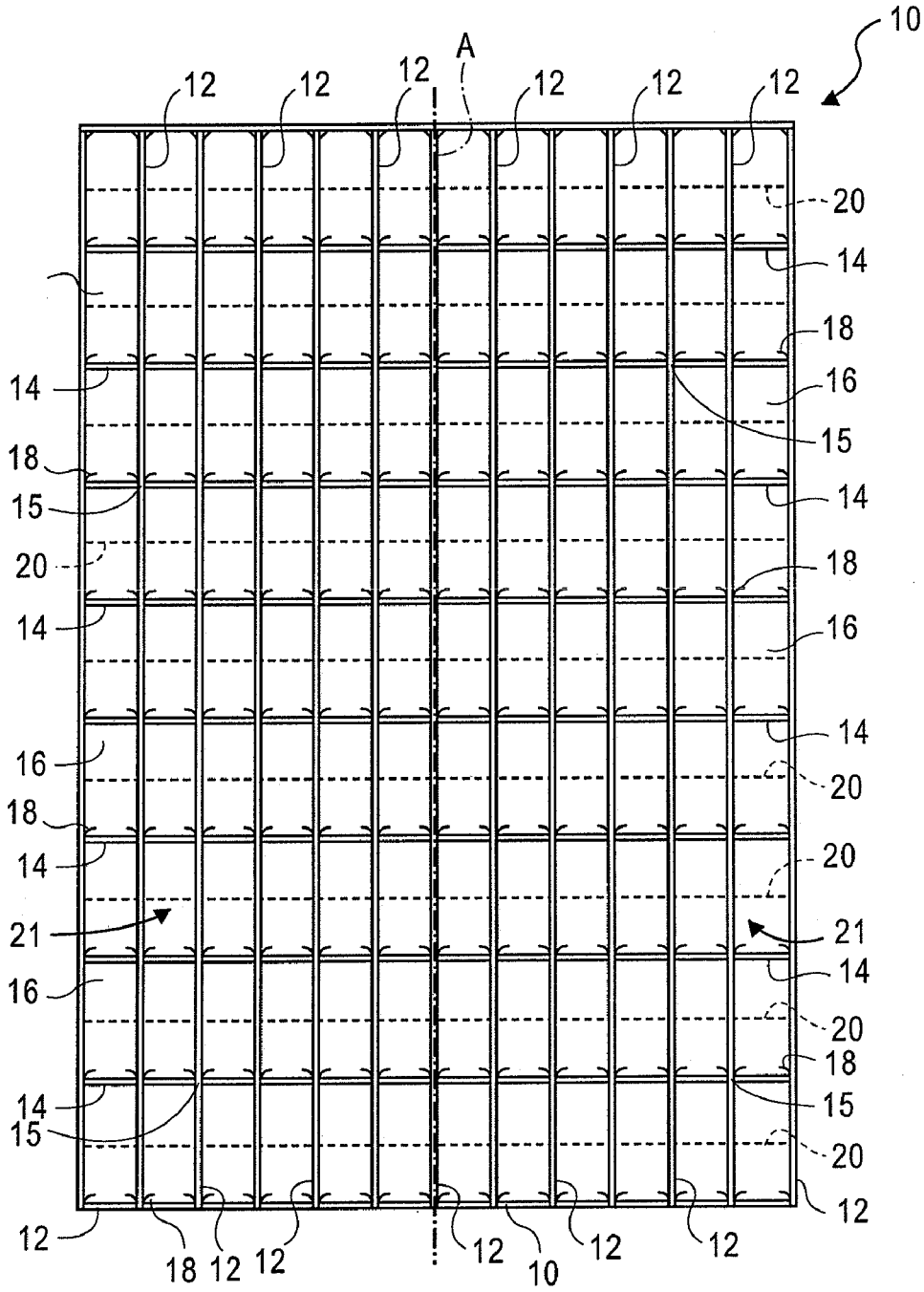
FIG. 1 schematically illustrates a support grid with unitary retainers and sliders in accordance with an embodiment of the present invention.

Various preferred embodiments of the present invention provide for a support grid with unitary clips and sliders for supporting splash bars in cooling tower assemblies, for example. In some arrangements, the support grid having unitary clips and sliders may also be employed in heating towers, for example. It should be understood, however, that the present invention is not limited in its application to cooling towers or heating towers, but, for example, may be used with other tower like structures requiring supporting structures or the like. Preferred embodiments of the invention will now be further described wither reference to the drawing figures, in which like reference numerals refer to like parts throughout.

Referring now to FIG. 1, a support grid, generally designated 10, for supporting splash bars in a cooling tower is illustrated. The support grid 10 includes a plurality of vertical column portions 12 and horizontal girt portions 14. The vertical columns 12 and horizontal girt portions 14 intersect one another at intersections 15 to provide the support grid 10 with a tic-tac-toe configuration.

The support grid 10 may be formed from any plastic and/or metal material as desired, for example, polypropylene and polyethylene. The column vertical portions 12 and horizontal girt portions 14 may be formed by injection molding processes, for example, or other molding procedures or processes known in the art.

As illustrated in FIG. 1, the columns 12 extend vertically, generally parallel to the longitudinal axis A of the support grid. The individual vertical columns 12 extend generally parallel to one another and may be spaced apart from one another any distance as the applications of the support grid 10 dictate. Preferably, however, the individual vertical columns 12 are spaced a distance apart equal to approximately 1 inch to approximately 7 inches. More preferably, the individual vertical columns 12 are spaced a distance apart equal to approximately 4 inches. The girts 14 extend horizontally generally normal or perpendicular to the longitudinal axis A and intersect the columns 12 at intersections 15, as previously described. The individual horizontal girts 14 extend generally parallel to one another and are spaced apart from one another a distance equal to approximately 5 inches to approximately 11 inches. More preferably, the individual horizontal girts 14 are spaced apart a distance equal to approximately 8 inches. All dimensions provided in this application are for example only and of course other suitable dimensions, ratios or sides may be used where appropriate.

The aforementioned orientation and positioning of the individual vertical columns 12 and horizontal girts 14, wherein the vertical columns 12 and horizontal girts 14 intersect one another at intersections 15, provides for the previously discussed tic-tac-toe configuration of the grid 10. As illustrated in FIGS. 1-7, this orientation of the vertical columns 12 and horizontal girts 14 forms a plurality of windows or spaces 16, around which the columns 12 and horizontal girts 14 form a perimeter. Due to the above-described spacing of the vertical columns 12 and horizontal girts 14, the windows 16 have a width that ranges from approximately 1 inch to approximately 7 inches and a height that ranges from approximately 5 inches to approximately 11 inches. More preferably, the windows 16 each have a size equal to approximately 4 inches by 8 inches.

The size of the individual windows 16 may vary, depending upon the spacing between the individual vertical columns 12 and the spacing between the individual horizontal girts 14 as previously described. For example, in the embodiments depicted in FIGS. 1-7, the width of the individual windows 16 is equal to approximately 4 inches and a height equal to approximately 8 inches.

Referring now to FIGS. 1-5, the support grid 10 includes a plurality of retainers 18 for retaining splash bars and the like. The retainers 18 are preferably unitary with the support grid 10 and extend in opposed relation to one another into the widow 16 in which the retainers 18 are located. As depicted in FIG. 1, in one embodiment of the present invention, a pair of retainers 18 may be disposed in each and every window 16 of the support grid 10 while in other embodiments of the present invention, the retainers 18 may be disposed periodically in the widows 16 as desired.

The retainers 18 as illustrated in FIGS. 1-5, function to retain or trap a splash bar or the like, the support grid 10 during operation of a cooling tower, for example. Accordingly, the retainers 18 as illustrated in FIGS. 1-5 are exemplary only, and may be of any geometry or size.

While in the illustrated preferred embodiment the retainers 18 are integral with the support grid 10, they may also be separate mounted components.

In another embodiment of the present invention, the support grid 10 may include windows 16 having only a single retainer 18 extending from one side of the window 16. Also, additional alternative embodiments may include windows 16 with a single retainer 18 and windows with a pair of retainers 18 in opposed relation as previously described.

As illustrated in FIG. 1, the retainers 18 extend from the columns 12 in opposed relation while the embodiments depicted in FIGS. 2-5, the retainers 18 extend from the intersections 15, or lower corners of the windows 16 in opposed relation. Alternatively, the support grid 10 may employ retainers 18 that extend in opposed relation from the horizontal girts 14 only.

Referring to FIGS. 1-5, the support grid 10 also includes slider portions 20 extending from vertical columns 14. The slider portions 20 are generally lateral extension areas or projections that extend from the vertical columns 14, at least partially into the windows 16 in opposed relation having a gap 21 therebetween. In the embodiments depicted in FIGS. 1-5, the slider portions 20 extend generally parallel to the horizontal girts 14, however the slider portions 20 may alternatively extend into the windows 16 at varying angles to the vertical columns 12.

As FIG. 1 depicts the support grid 10 having slider portions 20 disposed in all of the windows 16 of the support grid 10, however the slider portions 20 need not be disposed in every window 16. Like the retainer portions 18 previously discussed, slider portions 20 may disposed in selected windows 16 as the end user desires and/or as the application of the support grid 10 dictates.

While in the illustrated preferred embodiment the slider portions 20 are integral with the support grid 10, they may also be separate mounted components.

Accordingly, the scope of the present invention encompasses various embodiments of a support grid 10, for example, support grids 10 having windows 16 wherein each of the windows 16 has retainers 18 disposed therein. The present invention further encompasses an embodiment of the support grid 10, for example, wherein retainers 18 are disposed in selected or periodic windows 16 of the support grid 10. Similarly, the present invention includes embodiments of a support grid 10, for example, wherein the slider portions 20 are disposed in each of the windows 16 of the support grid 10. And alternatively, the present invention also includes embodiments of a support grid 10, for example, wherein the slider portions 20 are disposed in periodic or selected windows 16 as desired or as the support grid 10 applications require.

Figure 2:
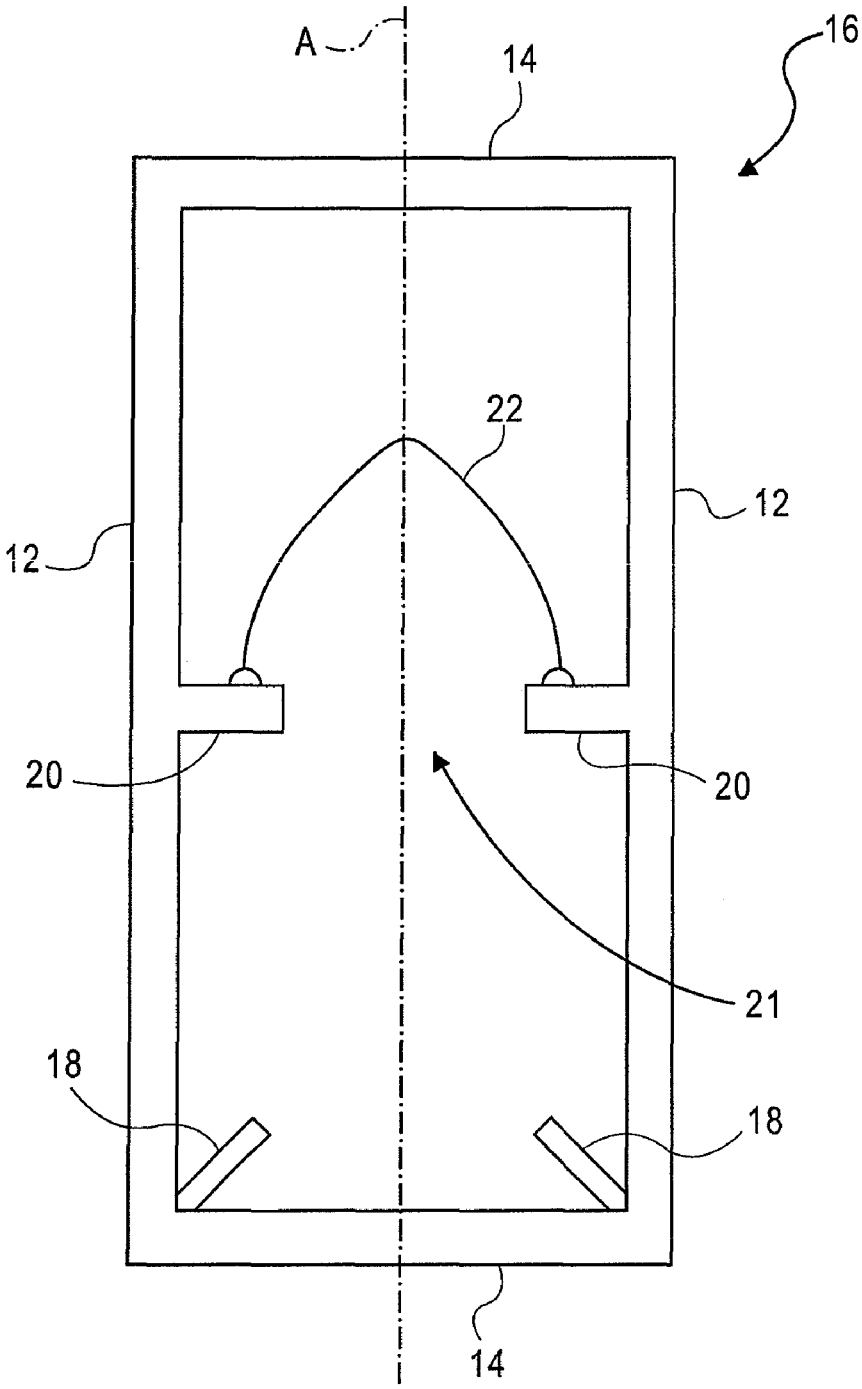
FIG. 2 schematically illustrates a support grid with unitary retainers and sliders with a splash bar in an installation position.
Figure 3:
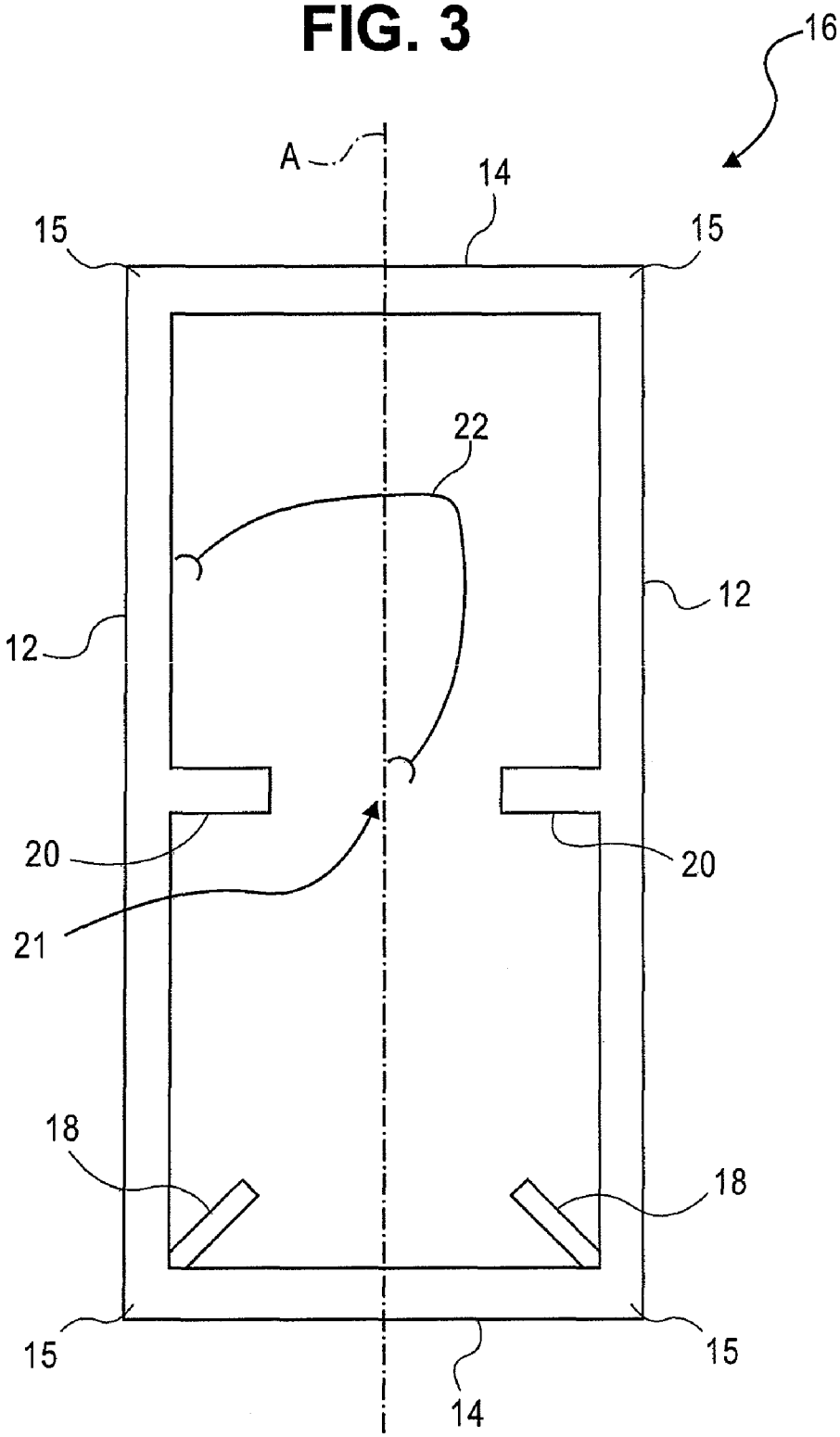
FIG. 3 schematically illustrates the support grid depicted in FIG. 2 with the splash bar transitioning from the installation position to an operational position.
Figure 4:
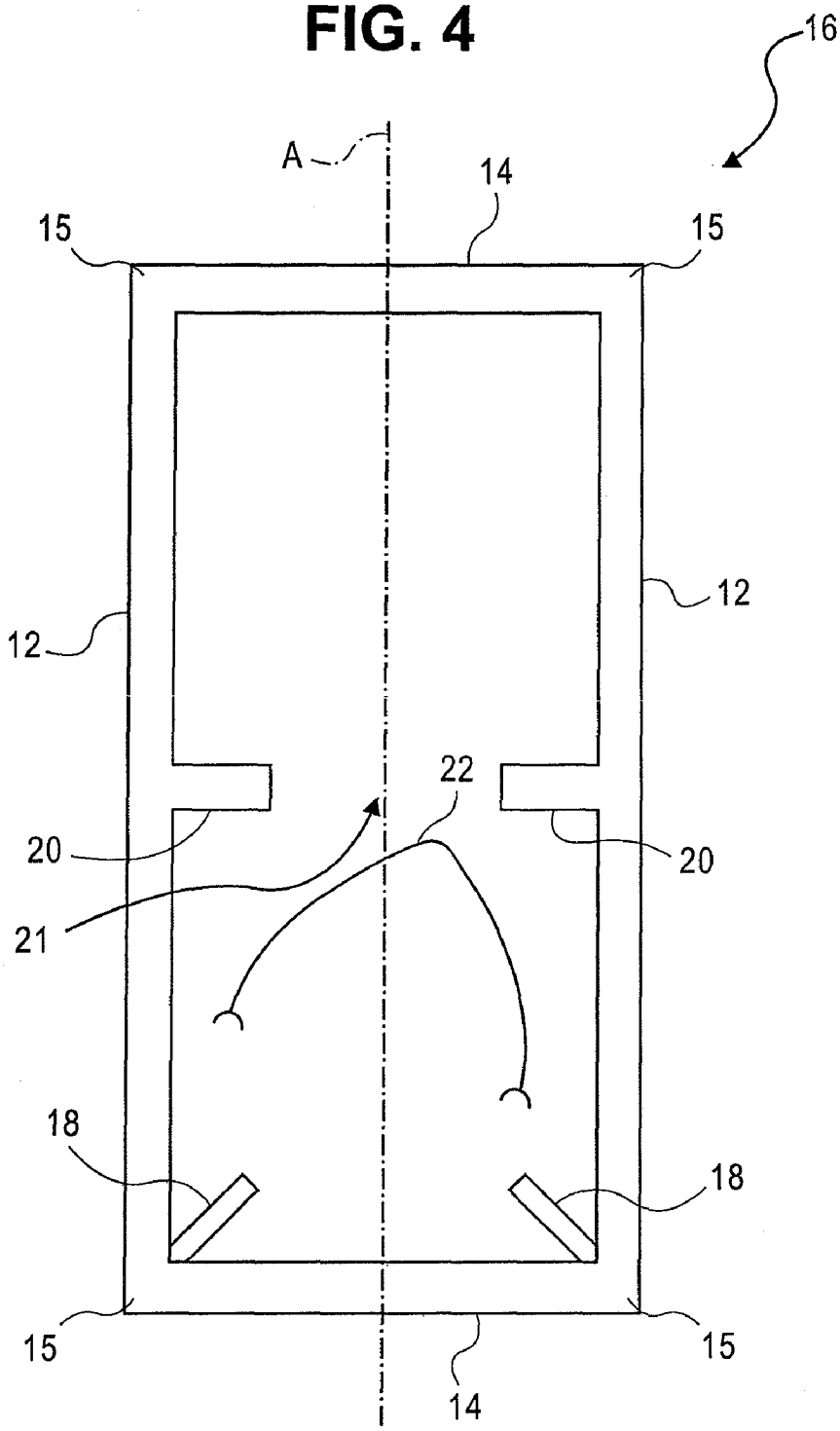
FIG. 4 schematically illustrates the support grid depicted in FIGS. 2 and 3, wherein with the splash bar is further transitioned from the installation position to the operational position.
Figure 5:
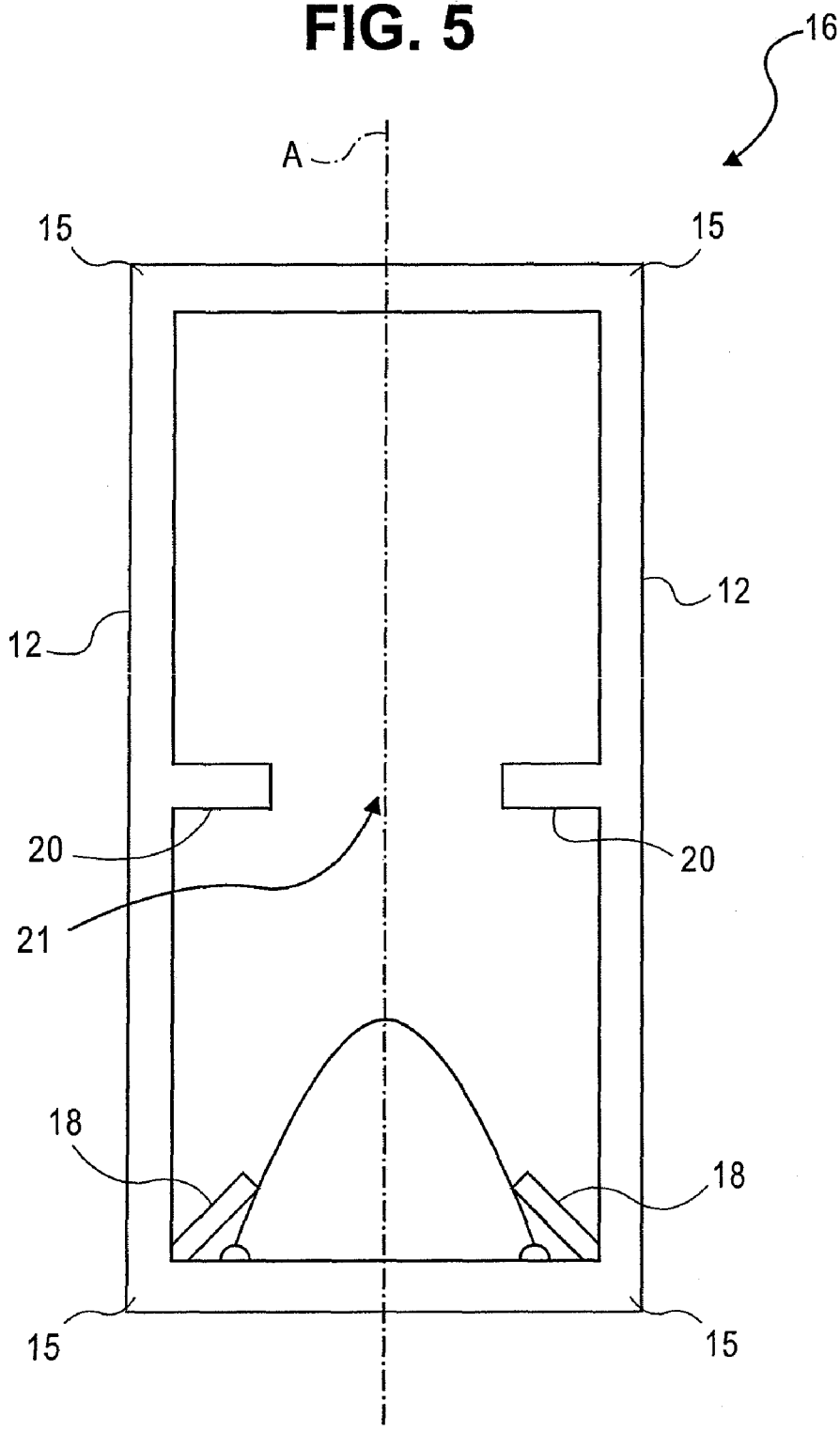
FIG. 5 schematically illustrates the support grid depicted in FIGS. 2, 3 and 4 with the splash bar in the operational position.

Referring now to FIGS. 2-5, the operation of the support grid 10 is illustrated wherein FIG. 2 depicts a splash bar, generally designated 22, in the installation position and FIG. 5 depicts the splash bar 22 in the operational position. FIGS. 3 and 4 illustrated the splash bar 22 transitioning from the installation position, as depicted in FIG. 2, to the operational position as depicted in FIG. 5.

Referring now to FIG. 2, an individual window 16 of the support grid 10 is depicted having a splash bar 22, positioned in the installation position. By installation position it is understood that the splash bar 22 is resting or supported by the slider portions 20 at an axial position along the longitudinal axis A, above the retainers 18. In this position, the slider portions 20 function to support the splash bar 22 above the retainers 18 during installation of the splash bars 22, in a cooling tower for example. Furthermore, the slider portions 20 also function to allow the splash bar 22 to slide back and forth during installation. For example, oftentimes cooling towers employ multiple support grid structures similar that depicted in FIGS. 1-6, wherein the individual splash bars span great distances through multiple windows of multiple, adjacently space support grids. Accordingly, the slider portions 20 provide a supporting surface upon which the individual splash bars may slide and not be obstructed by the retainers 18.

Referring now to FIG. 3, the splash bar 22 is illustrated transitioning from the installation position as illustrated in FIG. 2 to the operational position. The transitioning of the splash bar 22 initially starts by lifting the splash bar 22 upward along the longitudinal axis A, off of the slider portions 20 and rotating the splash bar 22 such that one end of the splash bar 22 can be positioned through the gap 21. Alternatively, the splash bar 22 may be flexed or yielded so that the splash bar 22 can be positioned or transitioned through the gap 21 between the opposed slider portions 20.

Referring now to FIG. 4, the splash bar 22 is illustrated in a transition position, wherein the splash bar 22 has transitioned through the gap 21. In this position, the splash bar 22 has cleared the gap 21 between the opposed slider portions 20 and is located at an axial position along the longitudinal axis A below the slider portions 20.

Referring now to FIG. 5, the splash bar 22 has completely transitioned from the installation position, as illustrated in FIG. 2, to the operational position. By operational position, it is understood that the splash bar 22 is retained or trapped to the horizontal girt 14 and ultimately the support grid 10 by the retainers 18. The aforementioned interaction between the retainers 18 and the splash bar 22 functions to prevent the likelihood of the splash bar 22 becoming dislodged from the support grid 10 during cooling tower operation, for example, due to impingement by water, flow of forced air through the cooling tower and/or fan vibration.

Figure 6:
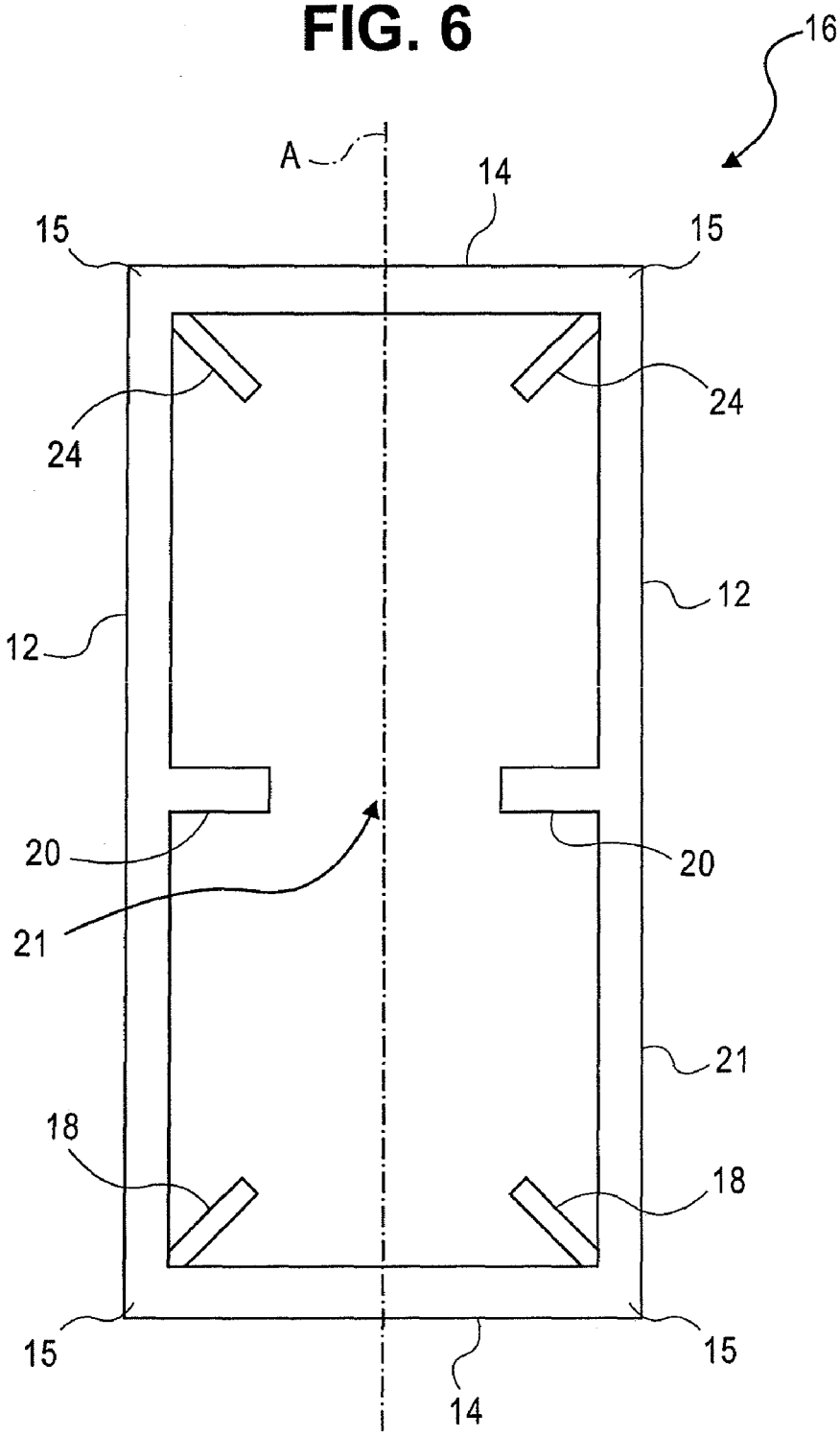
FIG. 6 schematically illustrates a window of a support grid having upper unitary retainers and lower unitary retainers along with sliders in accordance with another embodiment of the present invention.

Referring now to FIG. 6, a window 16 of the support grid 10 is illustrated in accordance with another embodiment of the present invention. Whereas the embodiments depicted in FIGS. 1-5 include one set of retainers 18, the embodiment depicted in FIG. 6 includes two sets of retainers, a lower first set of retainers 18 and an upper, second set of retainers 24. The lower retainers 18 preferably have a first geometry which allows the lower retainers 18 to be compatible with certain splash bar designs and geometries while the upper retainers 24 have a second geometry. This second geometry of the upper retainers 24 allows for the upper retainers 24 to be compatible with certain splash bar designs and geometries that are different than those splash bar designs that are compatible with the lower retainers 18. Accordingly, the upper retainers 24 allow for the support grid 10 to be rotated or flipped, enabling the support grid 10 to be compatible with splash bars having multiple designs and varying geometries. Alternatively, the upper retainers may have a similar shape and geometry as the lower retainers 18.

The upper retainers 24, like the lower retainers 18, are preferably unitary with the support grid 10 and extend in opposed relation to one another into the widow 16 in which the retainers 18 are located. As previously described in connection with the embodiments depicted in FIGS. 1-5, the upper retainers 24 may be disposed in each and every window 16 of the support grid 10 while in other embodiments the upper retainers 24 may be disposed in selected widows 16 as desired.

The upper retainers 24, similar to the lower retainers 18, function to retain or trap a splash bar or the like, to the support grid 10 during operation of a cooling tower, for example, in which the support grid 10 is disposed. Accordingly, the upper retainers 24 as illustrated in FIG. 6 are exemplary only, and may be of any geometry or size.

Figure 7:
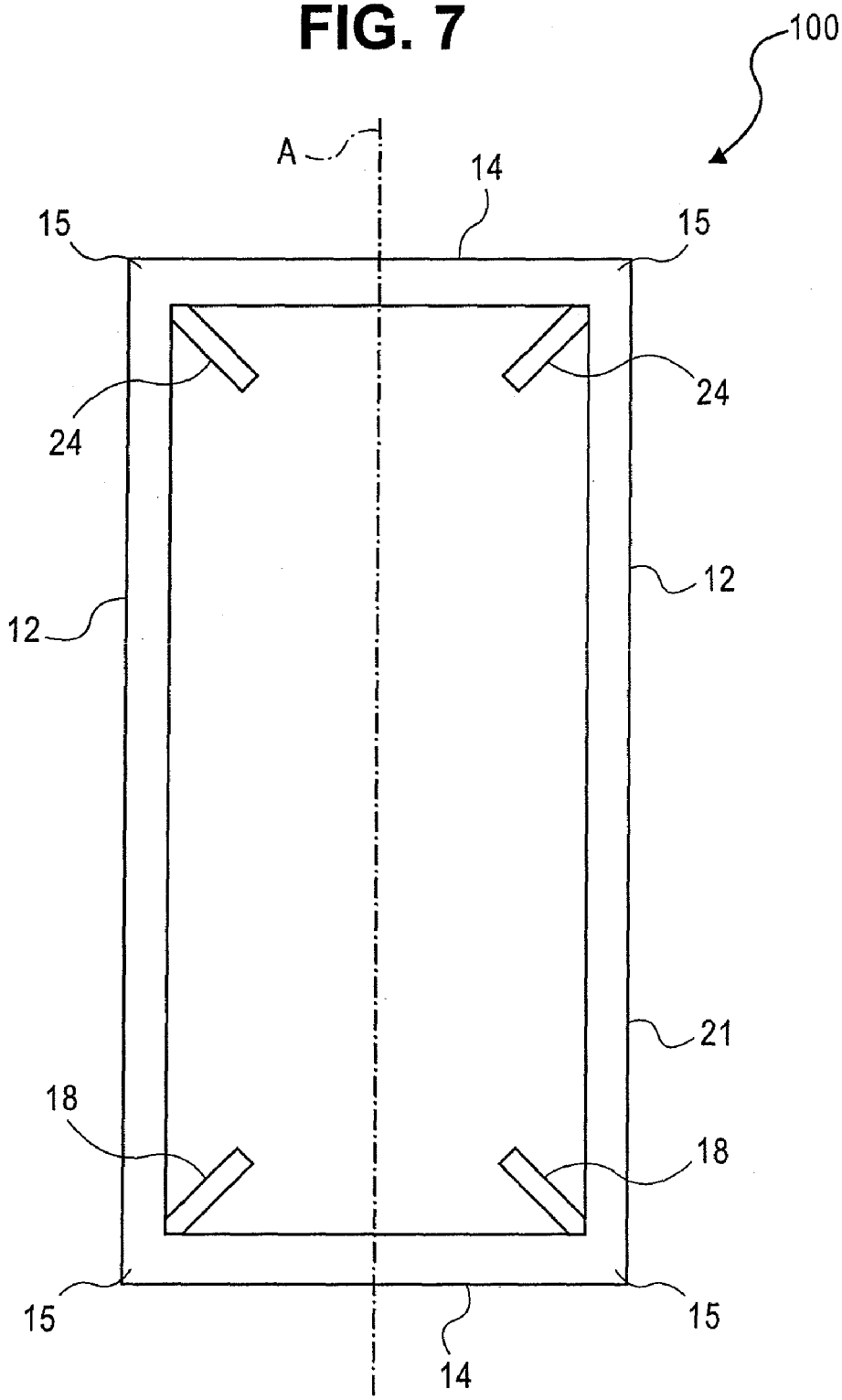
FIG. 7 schematically illustrates an alternative embodiment of the support grid window depicted in FIG. 6 having upper unitary retainers and lower unitary retainers in accordance with an embodiment of the present invention.

Referring now to FIG. 7, an alternative embodiment of the support grid window 16 depicted in accordance with the present invention. The support grid window, generally designated 100, illustrated in FIG. 7 is similar to that depicted in FIG. 6 having a lower first set of retainers 18 and an upper, second set of retainers 24. The window 100 differs from the previously described embodiment illustrated in FIG. 6 because it does not employ or utilize the sliders 20.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for installing and retaining a splash bar on a support grid having a longitudinal axis and frame having a series of columns and a series of girts that intersect said series of columns to form a plurality of windows having a width and a height, comprising:

supporting the splash bar on a pair of slider portions that extend in opposed relation from the frame into at least one of the plurality of windows at a first axial location with respect to the support grid thereof;

sliding the splash bar along the slider portions;

transitioning the splash bar from the slider portions along the longitudinal axis to engage a first retainer integral with the frame, wherein the retainer extends from the frame into the at least one of the plurality of windows at a second axial position with respect to the support grid thereof; and retaining the splash bar to the support grid via the first retainer wherein the slider portions are spaced and separated from the splash bar where the splash bar is retained by the first retainer.

2. The method according to claim 1, further comprising:

transitioning the splash bar to engage a second retainer integral with the frame, wherein the second retainer extends from the frame into the at least one of the plurality of windows at the second axial position thereof; and retaining the splash bar to the support grid via the second retainer.

3. The method according to claim 2, wherein the first retainer extends from one of the series of columns.

4. The method according to claim 3, wherein the second retainer extends from one of the series of columns.

5. The method according to claim 2, wherein the first retainer extends from one of the series of girts.

6. The method according to claim 5, wherein the second retainer extends from one of the series of girts.

7. A support grid having a longitudinal axis, comprising:

a frame having a series of columns and a series of girts that intersect said series of columns to form a plurality of windows having a width and a height, comprising:

means for supporting a splash bar, wherein said means for supporting includes a pair of means for sliding that extend in opposed relation from the frame into said at least one of the plurality of windows at a first axial location with respect to the support grid thereof; and means retaining the splash bar to the support grid via a retaining means wherein the slider portions are spaced and separated from the splash bar where the splash bar is retained by the first retainer.

* * * * *